US011759918B2

(12) United States Patent
Kukucka et al.

(10) Patent No.: US 11,759,918 B2
(45) Date of Patent: Sep. 19, 2023

(54) ANTI-SLIP TORQUE TOOL WITH INTEGRATED ENGAGEMENT FEATURES

(71) Applicant: GRIP HOLDINGS LLC, Brandon, FL (US)

(72) Inventors: Paul Kukucka, Brandon, FL (US); Thomas Stefan Kukucka, Brandon, FL (US)

(73) Assignee: GRIP HOLDINGS LLC, Brandon, FL (US)

( * ) Notice: Subject to any disclaimer, the term of this patent is extended or adjusted under 35 U.S.C. 154(b) by 277 days.

(21) Appl. No.: 17/160,224

(22) Filed: Jan. 27, 2021

(65) Prior Publication Data

US 2021/0146506 A1 May 20, 2021

Related U.S. Application Data

(63) Continuation-in-part of application No. 29/754,192, filed on Oct. 7, 2020, now Pat. No. Des. 966,063, and a continuation-in-part of application No. 16/872,050, filed on May 11, 2020, now Pat. No. 10,919,133, and (Continued)

(51) Int. Cl.

| | |
|---|---|
| ***B25B 13/06*** | (2006.01) |
| ***B25B 13/04*** | (2006.01) |
| ***B25B 23/00*** | (2006.01) |

(52) U.S. Cl.

CPC ..... *B25B 13/065* (2013.01); *B25B 13/04* (2013.01); *B25B 23/0071* (2013.01)

(58) Field of Classification Search

CPC ..... B25B 13/06; B25B 13/065; B25B 13/04; B25B 23/0071

See application file for complete search history.

(56) References Cited

U.S. PATENT DOCUMENTS

| | | | | |
|---|---|---|---|---|
| 1,798,944 A | | 3/1931 | Jackman | |
| 3,273,430 A | * | 9/1966 | Knudsen | B25B 13/065 81/124.6 |
| 3,405,377 A | | 10/1968 | Pierce | |

(Continued)

FOREIGN PATENT DOCUMENTS

| | | |
|---|---|---|
| AU | 201612229 | 4/2016 |
| AU | 201612720 | 6/2016 |

(Continued)

*Primary Examiner* — David B. Thomas

(57) ABSTRACT

An anti-slip torque tool with integrated engagement features includes a torque-tool body and a plurality of engagement features. The plurality of engagement features is radially distributed around a rotational axis of the torque-tool body. Each of the plurality of engagement features includes a first cavity surface, a first bracing surface, a second bracing surface, and a second cavity surface. The first bracing surface and the second bracing surface are adjacently connected to each other through an intersection point. The first cavity surface is terminally connected to the first bracing surface through a first connection point as the first bracing surface is positioned in between the second bracing surface and the first cavity surface. The second cavity surface is terminally connected to the second bracing surface through a second connection point as the second bracing surface is positioned in between the first bracing surface and the second cavity surface.

20 Claims, 14 Drawing Sheets

Related U.S. Application Data a continuation-in-part of application No. PCT/IB2020/054453, filed on May 11, 2020.

(60) Provisional application No. 62/845,731, filed on May 9, 2019.

(56) References Cited

U.S. PATENT DOCUMENTS

| | | | | |
|---|---|---|---|---|
| 3,495,485 | A * | 2/1970 | Knudsen | B25B 13/065 81/124.6 |
| 3,902,384 | A | 9/1975 | Ehrler | |
| 3,908,489 | A | 9/1975 | Yamamoto et al. | |
| 4,074,597 | A | 2/1978 | Jansson | |
| 4,512,220 | A * | 4/1985 | Barnhill, III | B25B 13/065 81/121.1 |
| 4,598,616 | A | 7/1986 | Colvin | |
| 4,607,547 | A | 8/1986 | Martus | |
| 4,882,957 | A * | 11/1989 | Wright | B25B 13/065 81/121.1 |
| 4,893,530 | A | 1/1990 | Warheit | |
| 4,927,020 | A | 5/1990 | Randy | |
| 4,930,378 | A | 6/1990 | Colvin | |
| 5,012,706 | A * | 5/1991 | Wright | B25B 13/065 81/121.1 |
| 5,019,080 | A | 5/1991 | Hemer | |
| 5,219,392 | A | 6/1993 | Ruzicka et al. | |
| 5,228,570 | A | 7/1993 | Robinson | |
| 5,251,521 | A | 10/1993 | Burda et al. | |
| 5,398,823 | A | 3/1995 | Anders | |
| 5,481,948 | A | 1/1996 | Zerkovitz | |
| 5,501,342 | A | 3/1996 | Geibel | |
| 5,519,929 | A | 5/1996 | Bleckman | |
| 5,645,177 | A | 7/1997 | Lin | |
| 5,669,516 | A | 9/1997 | Horn | |
| 5,725,107 | A | 3/1998 | Dembicks | |
| 5,743,394 | A | 4/1998 | Martin | |
| 5,782,148 | A | 7/1998 | Kerkhoven | |
| 5,829,327 | A | 11/1998 | Stanton | |
| 5,832,792 | A | 11/1998 | Hsieh | |
| 6,009,778 | A | 1/2000 | Hsieh | |
| 6,092,279 | A | 7/2000 | Shoup | |
| 6,352,011 | B1 | 3/2002 | Fruhm | |
| 6,431,373 | B1 | 8/2002 | Blick | |
| 6,575,057 | B1 | 6/2003 | Ploeger | |
| 6,626,067 | B1 | 9/2003 | Iwinski | |
| 6,698,316 | B1 | 3/2004 | Wright | |
| 6,755,098 | B2 | 6/2004 | Huang | |
| 6,761,089 | B2 | 7/2004 | Bergamo | |
| 6,857,340 | B2 | 2/2005 | Wagner | |
| 6,951,156 | B2 | 10/2005 | Garg | |
| 7,000,501 | B1 | 2/2006 | Chen | |
| D524,615 | S | 7/2006 | Albertson | |
| 7,225,710 | B2 | 6/2007 | Pacheco, Jr. | |
| 7,331,260 | B2 | 2/2008 | Cheng | |
| 7,717,278 | B2 | 1/2010 | Kao | |
| D614,931 | S | 5/2010 | Su | |
| 7,788,994 | B2 | 9/2010 | Wright et al. | |
| 7,841,480 | B2 | 11/2010 | Hsieh | |
| 7,913,593 | B2 | 3/2011 | Dahar et al. | |
| 8,166,851 | B2 | 5/2012 | Pchola et al. | |
| 8,302,255 | B2 | 11/2012 | Lin | |
| 8,336,709 | B1 | 12/2012 | Geibel | |
| D745,814 | S | 12/2015 | Hsieh | |
| 9,718,170 | B2 | 8/2017 | Eggert et al. | |
| 9,873,195 | B1 | 1/2018 | Buxton | |
| 9,878,441 | B1 | 1/2018 | Kao | |
| D829,069 | S | 9/2018 | Doroslovac et al. | |
| 10,081,094 | B2 | 9/2018 | Doroslovac et al. | |
| D859,944 | S | 9/2019 | Kukucka et al. | |
| D859,945 | S | 9/2019 | Kukucka et al. | |
| D859,946 | S | 9/2019 | Kukucka et al. | |
| D859,947 | S | 9/2019 | Kukucka et al. | |
| D867,841 | S | 11/2019 | Kukucka et al. | |
| D868,553 | S | 12/2019 | Kukucka et al. | |
| D879,577 | S | 3/2020 | Kukucka et al. | |
| D880,968 | S | 4/2020 | Kukucka et al. | |
| D880,977 | S | 4/2020 | Kukucka et al. | |
| D885,149 | S | 5/2020 | Kukucka et al. | |
| D887,233 | S | 6/2020 | Kukucka et al. | |
| D887,711 | S | 6/2020 | Kukucka et al. | |
| D889,224 | S | 7/2020 | Kukucka et al. | |
| D889,257 | S | 7/2020 | Kukucka et al. | |
| D892,578 | S | 8/2020 | Kukucka et al. | |
| 10,780,556 | B2 | 9/2020 | Kukucka et al. | |
| 10,786,890 | B2 | 9/2020 | Kukucka et al. | |
| D899,091 | S | 10/2020 | Kukucka et al. | |
| 10,828,766 | B2 | 11/2020 | Kukucka et al. | |
| D904,152 | S | 12/2020 | Kukucka et al. | |
| D906,781 | S | 1/2021 | Kukucka et al. | |
| 10,882,162 | B2 | 1/2021 | Kukucka et al. | |
| D909,842 | S | 2/2021 | Kukucka et al. | |
| D910,490 | S | 2/2021 | Lim et al. | |
| 10,919,133 | B2 | 2/2021 | Kukucka et al. | |
| 10,967,488 | B2 | 4/2021 | Kukucka et al. | |
| 2003/0209111 | A1 | 11/2003 | Huang | |
| 2004/0256263 | A1 | 12/2004 | Shih | |
| 2005/0098459 | A1 | 5/2005 | Gorman | |
| 2005/0103664 | A1 | 5/2005 | Shih | |
| 2005/0257357 | A1 | 11/2005 | Huang | |
| 2006/0130618 | A1 | 6/2006 | Hsieh | |
| 2006/0156869 | A1 | 7/2006 | Hsieh | |
| 2006/0266168 | A1 | 11/2006 | Pacheco, Jr. | |
| 2007/0261519 | A1 | 11/2007 | Cheng | |
| 2008/0235930 | A1 | 10/2008 | English | |
| 2009/0007732 | A1 | 1/2009 | Hsieh | |
| 2009/0120885 | A1 | 5/2009 | Kao | |
| 2009/0220321 | A1 | 9/2009 | Sakamura | |
| 2011/0056339 | A1 | 3/2011 | Su | |
| 2011/0303052 | A1 | 12/2011 | Chen | |
| 2012/0060656 | A1 | 3/2012 | Chang | |
| 2013/0047798 | A1 | 2/2013 | Huang | |
| 2014/0260832 | A1 | 9/2014 | Hsiao | |
| 2014/0331826 | A1 | 11/2014 | Campbell | |
| 2014/0360321 | A1 | 12/2014 | Steinweg et al. | |
| 2015/0135910 | A1 | 5/2015 | Eggert et al. | |
| 2015/0266169 | A1 | 9/2015 | Campbell, II | |
| 2015/0314429 | A1 | 11/2015 | Doroslovac | |
| 2016/0067853 | A1 | 3/2016 | Neto | |
| 2016/0136792 | A1 | 5/2016 | Harp | |
| 2016/0223005 | A1 | 8/2016 | Rathmann | |
| 2016/0339564 | A1 | 11/2016 | Chen | |
| 2017/0282337 | A1 | 10/2017 | Johnson et al. | |
| 2017/0312839 | A1 | 11/2017 | Moss et al. | |
| 2017/0312897 | A1 | 11/2017 | Doroslovac et al. | |
| 2018/0003241 | A1 | 1/2018 | Goss | |
| 2018/0141192 | A1 | 5/2018 | Chang | |
| 2018/0354022 | A1 | 12/2018 | Ross et al. | |
| 2018/0354102 | A1 | 12/2018 | Kukucka et al. | |
| 2019/0001469 | A1 | 1/2019 | Cho et al. | |
| 2019/0015961 | A1 | 1/2019 | Kukucka et al. | |
| 2019/0152033 | A1 | 5/2019 | Kukucka et al. | |
| 2019/0217449 | A1 | 7/2019 | Lee | |
| 2019/0283233 | A1 | 9/2019 | Kukucka et al. | |
| 2019/0337131 | A1 | 11/2019 | Kukucka et al. | |
| 2019/0375077 | A1 | 12/2019 | Kukucka et al. | |
| 2020/0078908 | A1 | 3/2020 | Wu et al. | |
| 2020/0298380 | A1 | 9/2020 | Doroslovac et al. | |
| 2020/0376648 | A1 | 12/2020 | Kukucka et al. | |
| 2020/0391360 | A1 | 12/2020 | Kukucka et al. | |
| 2021/0039245 | A1 | 2/2021 | Kukucka et al. | |

FOREIGN PATENT DOCUMENTS

| | | | |
|---|---|---|---|
| AU | 201612721 | | 6/2016 |
| CA | 2564093 | A1 | 4/2007 |
| CA | 168071 | | 12/2016 |
| CA | 2898480 | A1 | 7/2017 |
| CN | 2767068 | Y | 3/2006 |
| CN | 3630254 | | 6/2006 |
| CN | 201046555 | Y | 4/2008 |
| CN | 102395447 | | 3/2012 |
| CN | 102554833 | A | 7/2012 |
| CN | 303924849 | | 11/2016 |

(56) References Cited

FOREIGN PATENT DOCUMENTS

| | | | |
|---|---|---|---|
| CN | 303956827 | | 12/2016 |
| CN | 303984883 | | 12/2016 |
| CN | 207548606 | U | 6/2018 |
| DE | 3911409 | A1 | 10/1990 |
| DE | 29613327 | U1 | 9/1996 |
| DE | 10321284 | A1 | 12/2004 |
| DE | 202010006146 | U1 | 7/2010 |
| DE | 202012103034 | U1 | 11/2012 |
| DE | 102013021238 | A1 | 6/2015 |
| EP | 1371453 | A2 | 12/2003 |
| EP | 1731774 | A1 | 12/2006 |
| GB | 906839 | A | 9/1962 |
| GB | 1294764 | A | 11/1972 |
| JP | 2011143522 | | 7/2011 |
| JP | 2012157913 | | 10/2011 |
| JP | 2015180835 | A | 7/2017 |
| KR | 200149097 | Y1 | 7/1999 |
| RU | 2152870 | C1 | 7/2000 |
| RU | 2225786 | C2 | 1/2001 |
| RU | 45671 | U1 | 5/2005 |
| RU | 58510 | U1 | 11/2006 |
| RU | 2387533 | C1 | 4/2010 |
| RU | 116398 | | 5/2012 |
| RU | 180548 | U1 | 6/2018 |
| SU | 16616 | A1 | 8/1930 |
| WO | WO9416862 | A1 | 8/1994 |
| WO | WO1996010932 | A1 | 4/1996 |
| WO | WO1996026870 | A1 | 9/1996 |
| WO | WO1996027745 | A1 | 9/1996 |
| WO | WO9710926 | | 3/1997 |
| WO | 9812982 | A1 | 4/1998 |
| WO | WO9932264 | | 7/1999 |
| WO | WO0166312 | A1 | 9/2001 |
| WO | WO2004002687 | A1 | 1/2004 |
| WO | WO2005070621 | | 8/2005 |
| WO | WO2006023374 | | 3/2006 |
| WO | WO2006130490 | A1 | 12/2006 |
| WO | WO2010007402 | A1 | 1/2010 |
| WO | WO2011109040 | A1 | 9/2011 |
| WO | WO2015082283 | A1 | 6/2015 |
| WO | 2015050942 | A1 | 9/2015 |
| WO | DM090809 | | 4/2016 |
| WO | WO2016051080 | A1 | 4/2016 |
| WO | 091189 | | 5/2016 |
| WO | DM091188 | | 5/2016 |
| WO | WO2016174615 | A1 | 11/2016 |
| WO | WO2017178997 | | 10/2017 |
| WO | WO2018172831 | | 9/2018 |
| WO | WO2019012486 | | 1/2019 |
| WO | WO2019167032 | | 9/2019 |
| WO | WO2019175652 | | 9/2019 |
| WO | WO2020039281 | | 2/2020 |
| WO | WO2020039285 | | 2/2020 |
| WO | WO2020058777 | | 3/2020 |
| WO | WO2020152516 | | 7/2020 |
| WO | WO2020208608 | | 10/2020 |
| WO | WO2020225800 | | 11/2020 |
| WO | WO2021001696 | | 1/2021 |
| WO | WO2021019500 | | 2/2021 |
| WO | WO2021033152 | | 2/2021 |

* cited by examiner

ANTI-SLIP TORQUE TOOL WITH INTEGRATED ENGAGEMENT FEATURES

The current application is a continuation-in-part (CIP) application of a U.S. non-provisional application Ser. No. 16/872,050 filed on May 11, 2020. The U.S. non-provisional application Ser. No. 16/872,050 claims a priority to a U.S. provisional application Ser. No. 62/845,731 filed on May 9, 2019.

The current application is also a continuation-in-part (CIP) application of the Patent Cooperation Treaty (PCT) application PCT/IB2020/054453 filed on May 11, 2020.

FIELD OF THE INVENTION

The present invention generally relates to various fastening methods. More specifically the present invention is an anti-slip torque tool with integrated engagement features to prevent damaging or stripping fasteners during the extraction or tightening process.

BACKGROUND OF THE INVENTION

Hex bolts, nuts, screws, and other similar threaded devices are used to secure and hold multiple components together by being engaged to a complimentary thread, known as a female thread. The general structure of these types of fasteners is a cylindrical shaft with an external thread and a head at one end of the shaft. The external thread engages a complimentary female thread tapped into a hole or a nut and secures the fastener in place, fastening the associated components together. The head receives an external torque force and is the means by which the fastener is turned, or driven, into the female threading. The head is shaped specifically to allow an external tool like a wrench to apply a torque to the fastener in order to rotate the fastener and engage the complimentary female threading to a certain degree. This type of fastener is simple, extremely effective, cheap, and highly popular in modern construction. One of the most common problems in using these types of fasteners, whether male or female, is the tool slipping in the head portion, or slipping on the head portion. This is generally caused by either a worn fastener or tool, corrosion, overtightening, or damage to the head portion of the fastener.

It is an objective of the present invention to provide a torque tool that virtually eliminates slippage, when used in conjunction with the appropriate matching fastener. The present invention uses a series of segmented portions that engage and/or bite into the head of the fastener and allow for efficient torque transfer between the torque tool and the head portion of the fastener. The present invention eliminates the need for the common bolt extractors as they require unnecessary drilling and tools. The present invention is preferably built into an opened end, a boxed end wrench type torque tool, or socket wrench so that the users can selectively utilize the present invention with reference to the different types of fasteners.

DETAIL DESCRIPTIONS OF THE INVENTION

All illustrations of the drawings are for the purpose of describing selected versions of the present invention and are not intended to limit the scope of the present invention.

The present invention is anti-slip torque tool with integrated engagement features that is used to tighten or loosen any fastener such as a nut or bolt. Traditional wrench and wrench socket designs transfer the majority of the torque to the fastener through the lateral corners of the fastener head. Over time, the degradation of the lateral corners reduces the efficiency of transferring torque from the wrench to the fastener head and, as a result, causes slippage. The present invention overcomes this problem through the use of various engagement features including, but not limited to, grooves, serration, ribs, edges, and surfaces integrated into the lateral surfaces of the torque tool which provide an additional biting point for the fastener head, regardless of the wear and tear of the fastener head.

The present invention utilizes various engagement features including, but not limited to, grooves, serration, ribs, edges, surfaces, and teeth to engage the lateral surface of fastener head away from the lateral corner of the male fastener head, damaged or otherwise, in order to efficiently apply torque onto the fastener. The sets of teeth allow an improved grip to be applied on to the fastener head by a torque tool. The present invention may be integrated into or utilized by a variety of general tools to increase the torque force applied to a fastener. General tools include, but are not limited to, open-end wrenches, boxed-end wrenches, adjustable wrenches, pipe wrenches, socket wrenches, plumber wrench, and other similar fastener engaging tools. The present invention is compatible with male-member based head fasteners. Fasteners which utilize a male-member head design, also known as male fasteners, use the external lateral surface of the fastener head to engage a tool for tightening or loosening, such fasteners include but are not limited to twelve point and or hex bolts and nuts. In addition, the present invention is also compatible with female-member based head designs of fasteners. Fasteners that utilize a female-member head design uses the internal lateral surface of the fastener head to engage a tool for tightening or loosening. In addition, the present invention is compatible with fasteners of a right-hand thread and fasteners of a left-hand thread. Furthermore, the present invention may be altered and configured to fit different types and different sizes of fasteners.

Figure 1:
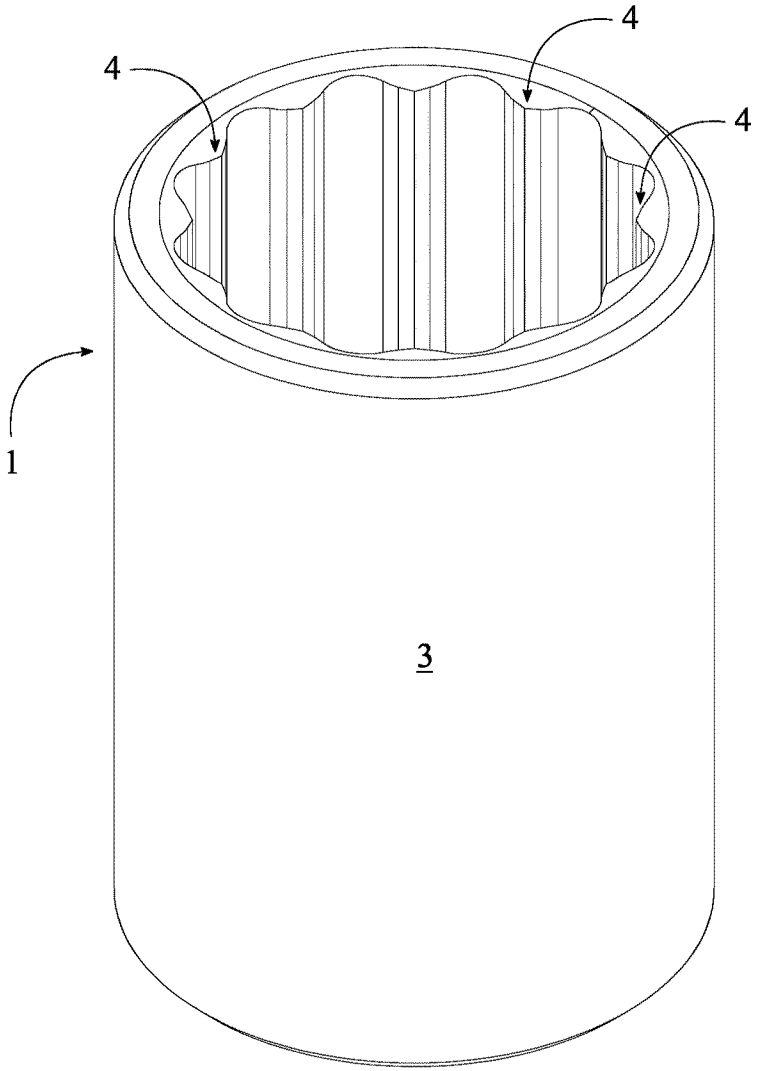
FIG. 1 is a top perspective view of a preferred embodiment of the present invention.
Figure 2:
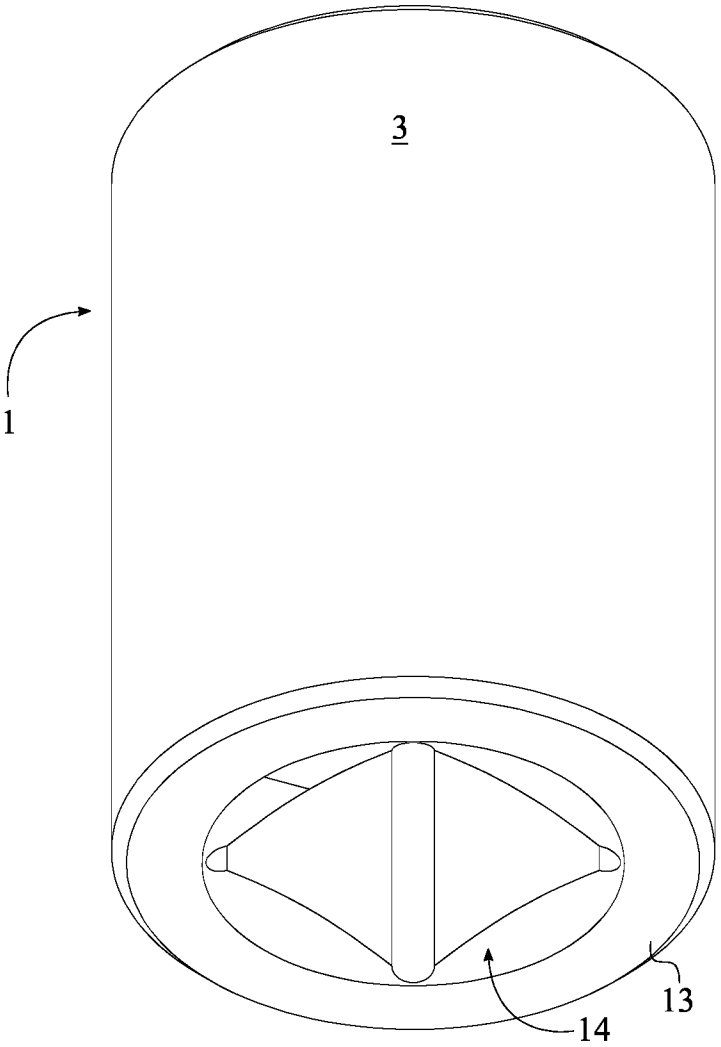
FIG. 2 is a bottom perspective view of the preferred embodiment of the present invention.
Figure 4:
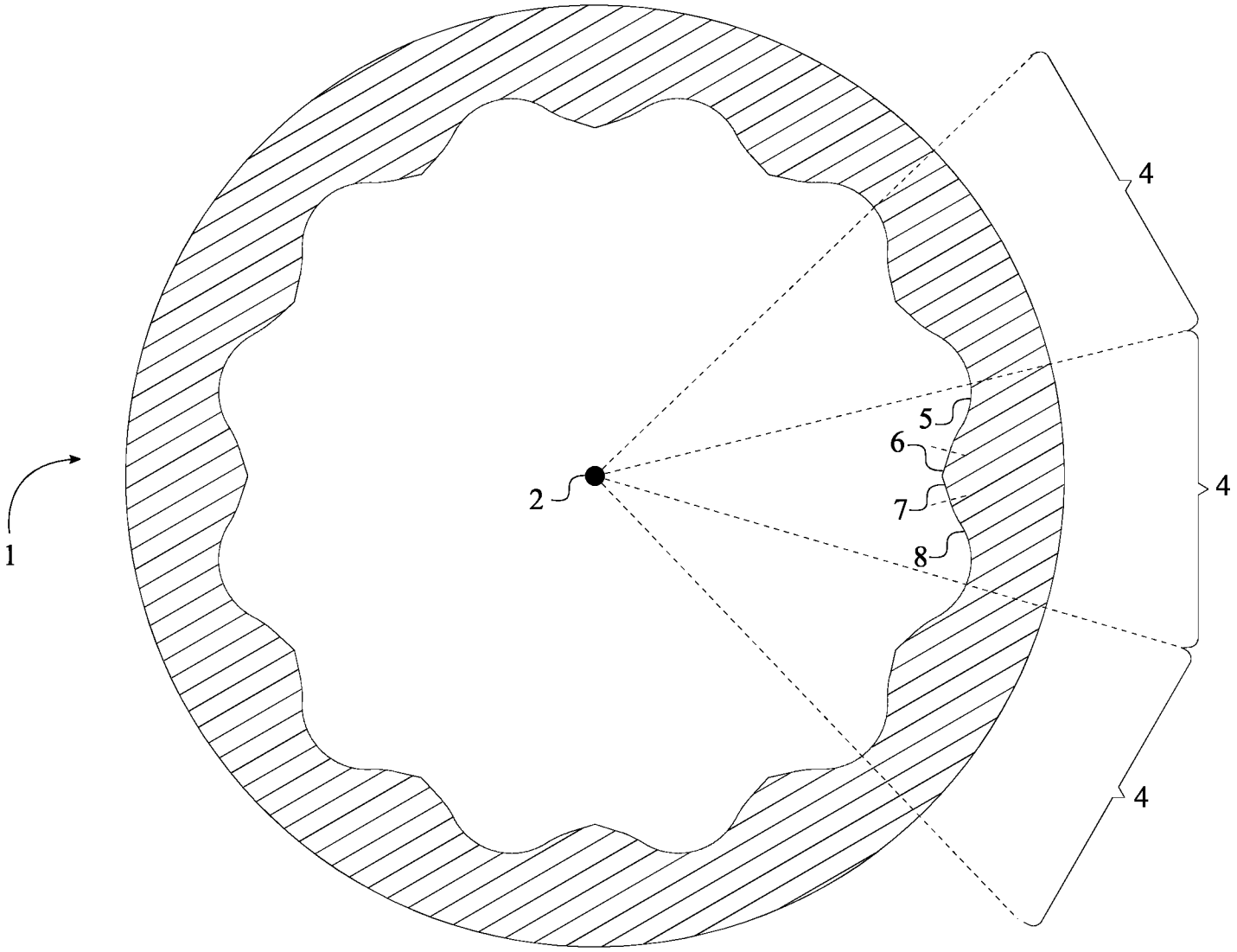
FIG. 4 is a cross section view of the preferred embodiment of the present invention taken along line 4-4 of FIG. 3.

In reference to FIG. 1-2, the present invention comprises a torque-tool body 1 and a plurality of engagement features 4. The torque-tool body 1 is used as a physical structure to apply torque onto the fastener head. In particular, the wrench torque-tool body 1 is extrusion sized to fit around the male fastener in an interlocking manner. Each of the plurality of engagement features 4 that facilitate interlocking aspect comprises a first cavity surface 5, a first bracing surface 6, a second bracing surface 7, and a second cavity surface 8 as shown in FIG. 4. In order to fit around the male fastener and transfer torque, the plurality of engagement features 4 is radially distributed around a rotational axis 2 of the torque-tool body 1. In reference to each of the plurality of engagement features 4, the first bracing surface 6 and the second bracing surface 7 are adjacently connected to each other through an intersection point 9. The first cavity surface 5 is terminally connected to the first bracing surface 6 through a first connection point 10 in such a way that the first bracing surface 6 is positioned in between the second bracing surface 7 and the first cavity surface 5. The second cavity surface 8 is terminally connected to the second bracing surface 7 through a second connection point 11 in such a way that the second bracing surface 7 is positioned in between the first bracing surface 6 and the second cavity surface 8.

Figure 3:
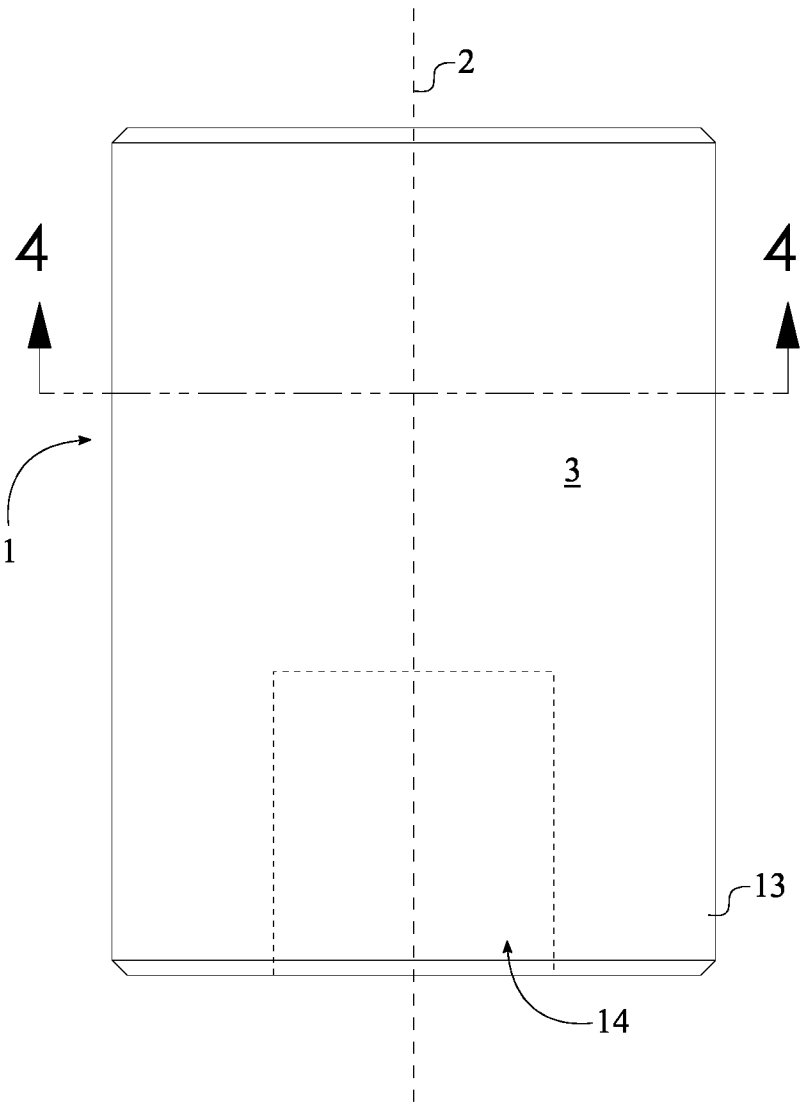
FIG. 3 is a side view of the preferred embodiment of the present invention, showing the plane upon which a cross sectional view is taken shown in FIG. 4.

In reference to FIG. 1-2, a preferred embodiment of the present invention, the torque-tool body 1 is outwardly extended from the plurality of engagement features 4 to an outer wall 3 of the torque tool body thus delineating a female-socket. The present invention further comprises an attachment body 13 and a square engagement bore 14 in order to receive a male attachment member of a socket wrench as shown in FIG. 2-3.

More specifically, the attachment body 13 is centrally positioned around and along the rotational axis 2 in order to align with the axis of rotation of the external torque applying tool. The attachment body 13 is connected adjacent to the torque-tool body 1 and so that the square engagement bore 14 can be traversed into the attachment body 13 along the rotational axis 2 opposite of the torque-tool body 1. As a result, the male attachment member of the socket wrench is able to engage with the square engagement bore 14 thus allowing the socket wrench to apply torque to the present invention. In other words, a receiver opening is delineated normal to the torque-tool body 1 and within the plurality of engagement features 4. As a result, the female-socket is able to externally engage around the male fastener that needs to be removed or tightened.

An alternative embodiment of the present invention, the torque-tool body 1 can outwardly extend from the rotational axis 2 to the plurality of engagement features 4 thus delineating a male-driver bit. Resultantly, the attachment body 13 is preferably of a hexagonal shaped body with a diameter preferably and slightly larger than the diameter for the torque-tool body 1. However, the attachment body 13 may incorporate a smaller diameter than the torque-tool body 1 depending upon the preferred manufacturing method or design. In other words, the male-driver bit generally associates with an opening of the female-member head design so that the plurality engagement features can internally engage with the fastener head. The male-driver bit engages a female fastener away from the center and towards the lateral edge.

Figure 14:
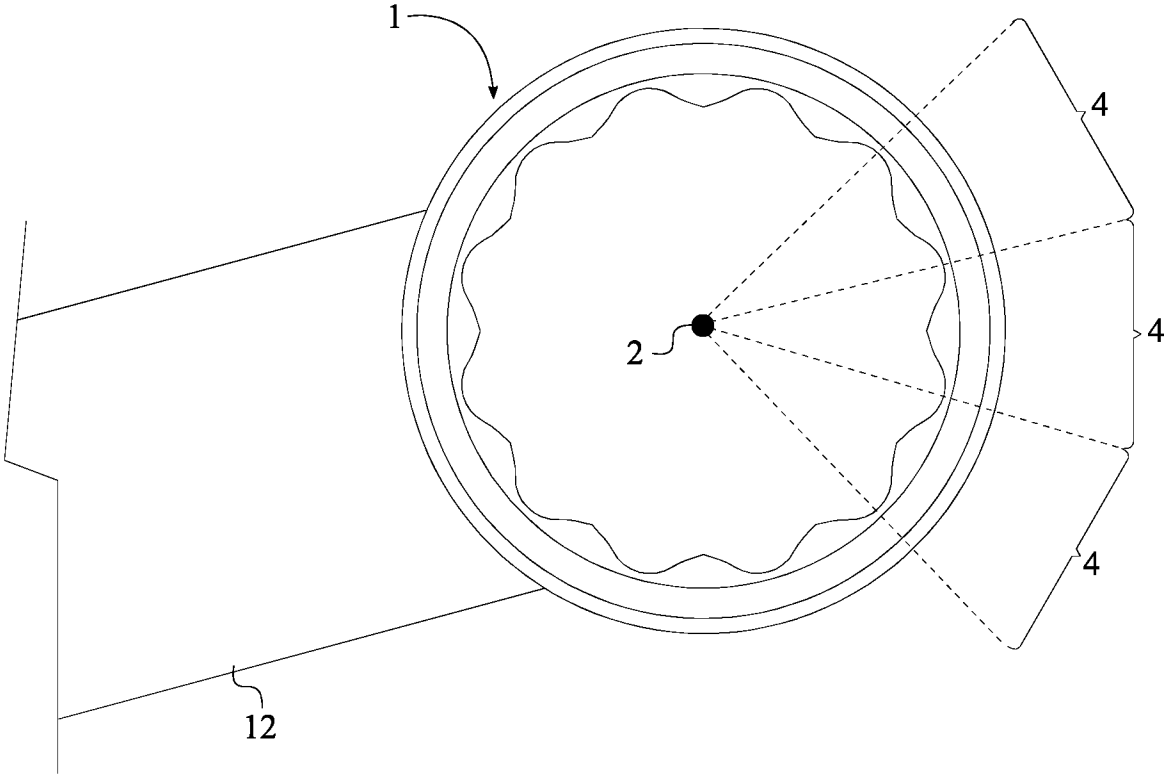
FIG. 14 is a top view showing the plurality of engagement features of an embodiment of the present invention, showing the wrench handle.

In reference to FIG. 14, the present invention can further comprise a wrench handle 12 so that the user can easily apply torque to the torque-tool body 1. More specifically, the wrench handle 12 is externally and laterally connected to the torque-tool body 1. For an example, when the torque is applied to the wrench handle 12 in the clockwise or counterclockwise direction, the torque-tool body 1 is also able to simultaneously rotate with the wrench handle 12 thus transferring the applied torque to the male fastener.

Figure 5:
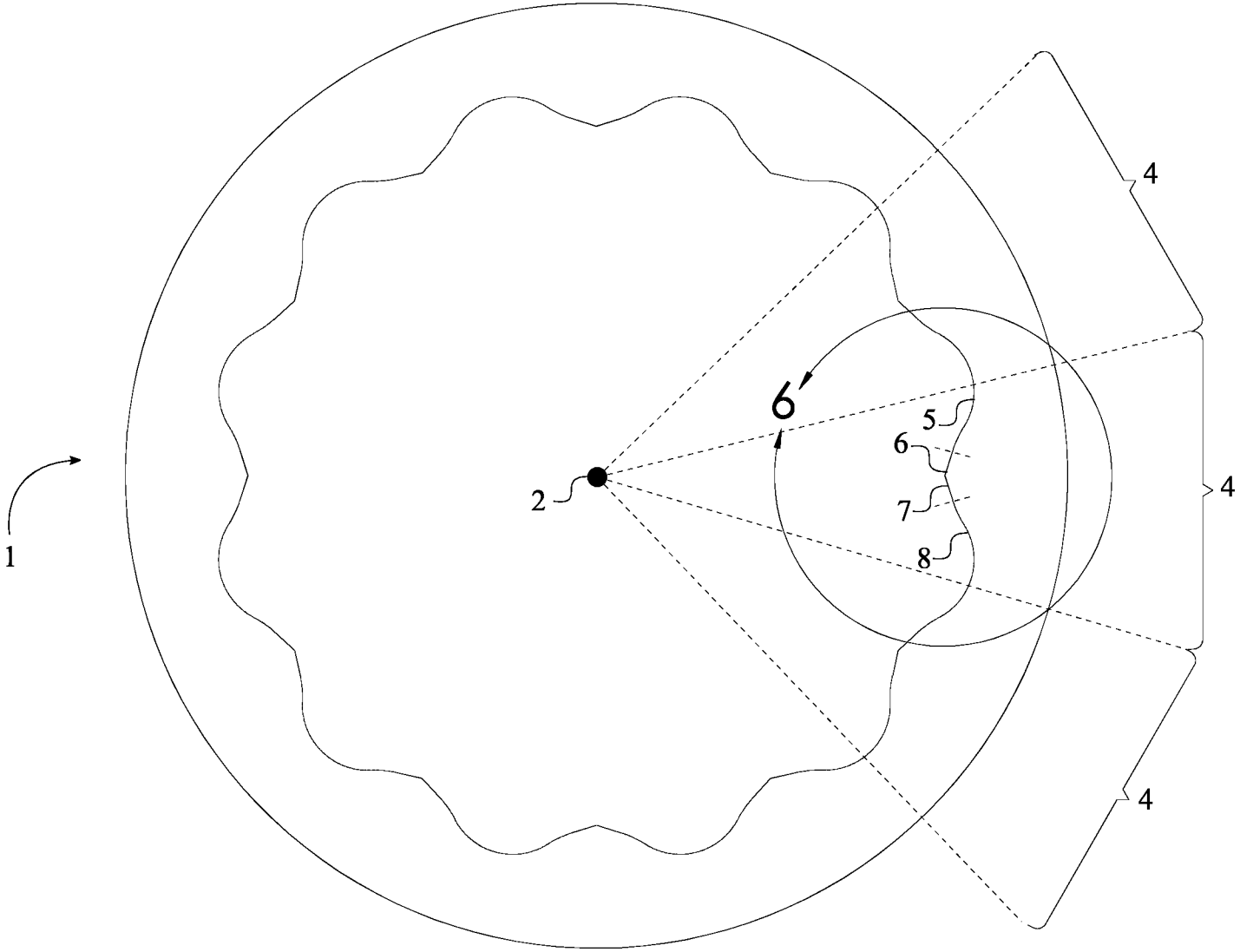
FIG. 5 is a cross section view of the preferred embodiment of the present invention, showing only the plurality of engagement features and a detailed view of one of the plurality of engagement features is taken shown in FIG. 5.
Figure 6:
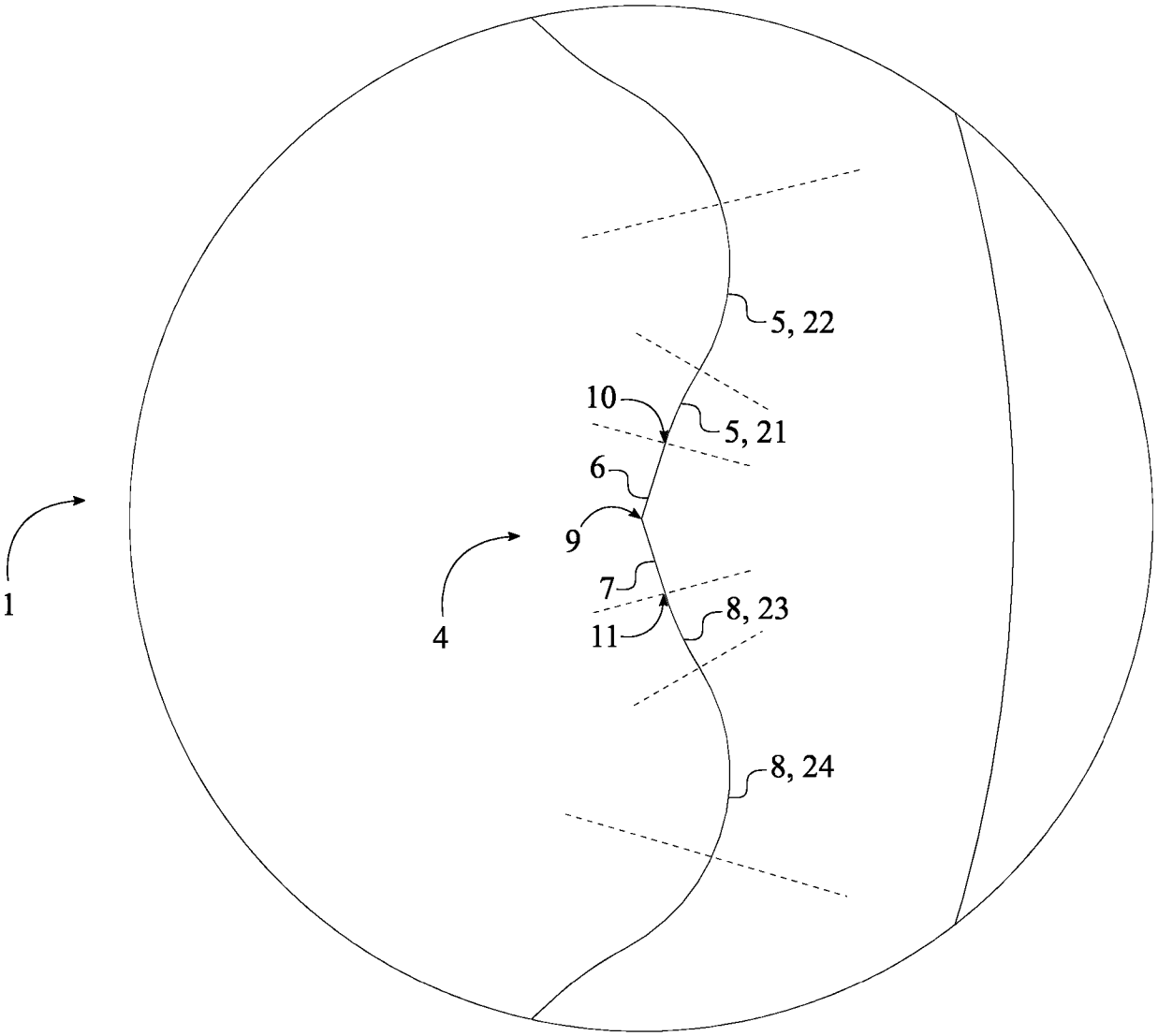
FIG. 6 is a detailed view showing one of the plurality of engagement features of the preferred embodiment of the present invention, wherein the intersection point is a sharp point and a length of the first bracing surface is equal to a length of the second bracing surface and showing the first convex section and the second convex section.
Figure 7:
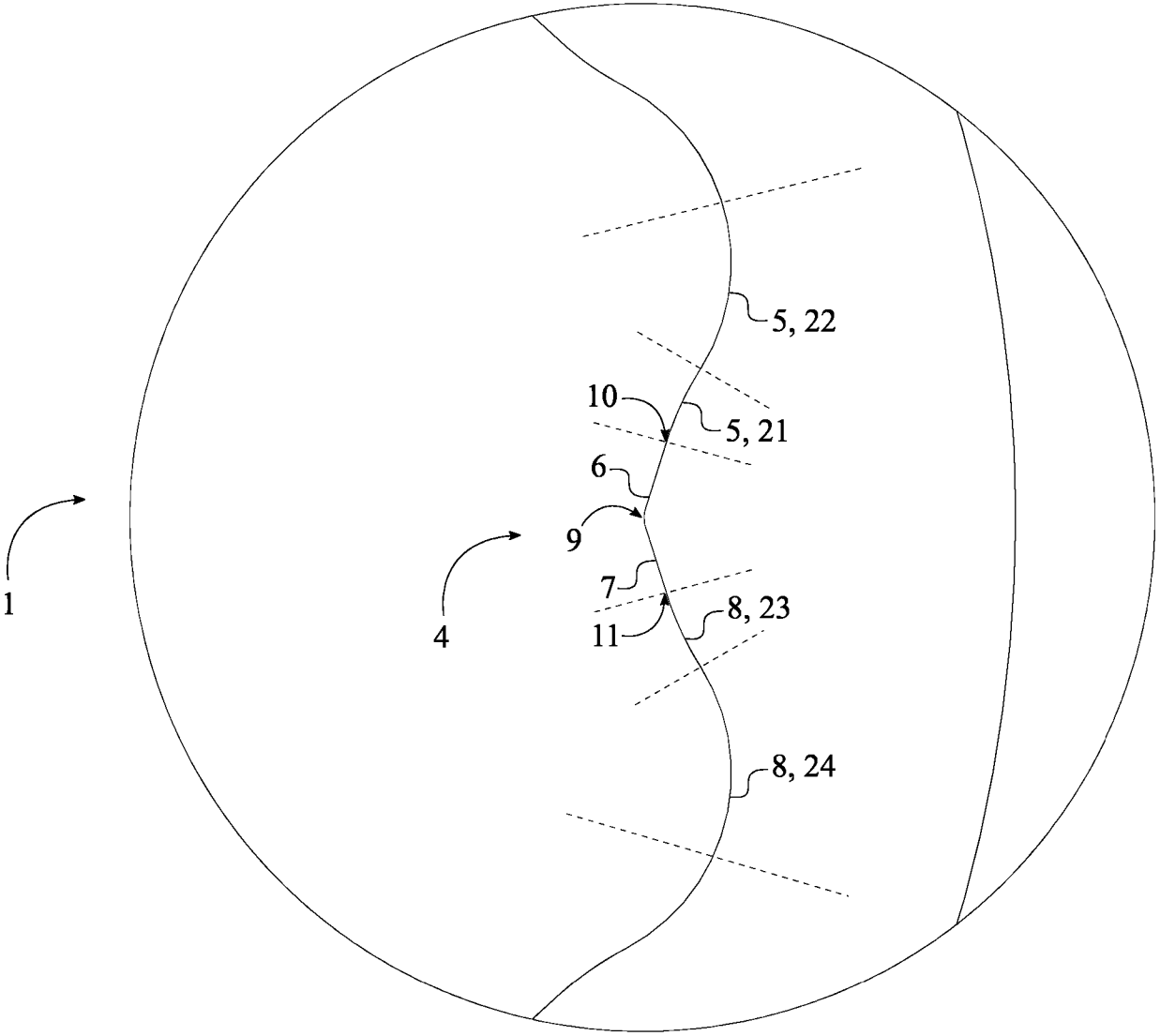
FIG. 7 is a detailed view showing one of the plurality of engagement features of the preferred embodiment of the present invention, wherein the intersection point is a curved section.
Figure 13:
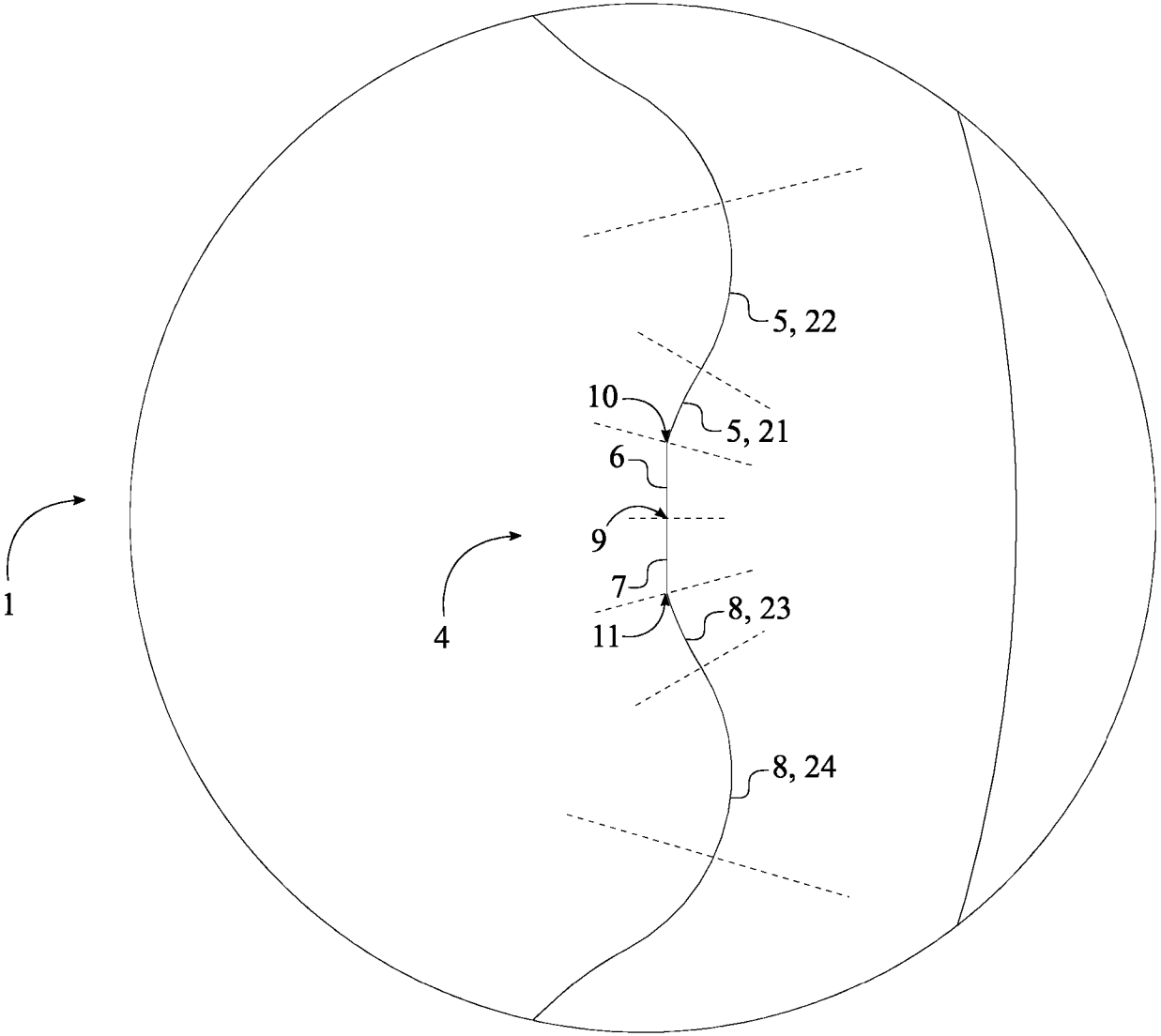
FIG. 13 is a detailed view showing one of the plurality of engagement features of an embodiment of the present invention, wherein the first bracing surface and the second bracing surface are parallel to each other.

In reference to FIG. 5, the preferred embodiment of the present invention, the first bracing surface 6 and the second bracing surface 7 are angularly positioned to each other about the intersection point 9 in order to maximize the torque transfer into the fastener head as the intersection point 9 is able to engage or bite into the fastener head. More specifically, the intersection point 9 is identified as the meeting points of the first bracing surface 6 and the second bracing surface 7. Depending upon different embodiment of the present invention, the intersection point 9 can be a sharp point or a curved section similar to a small radius as shown in FIG. 6-7. However, an alternative embodiment of the present invention, the first bracing surface 6 and the second bracing surface 7 can be positioned parallel to each other as shown in FIG. 13. As a result, the first bracing surface 6 and the second bracing surface 7 are able to fully press against a lateral wall of the male fastener head possibly without having to bite into the fastener head.

Preferably, the first bracing surface 6 and the second bracing surface 7 are formed into a flat surface area within the present invention. However, the first bracing surface 6 and the second bracing surface 7 can also be formed into a concave surface area or a convex surface area in different embodiments of the present invention.

In reference to FIG. 6, the first connection point 10 is delineated as the meeting point of the first cavity surface 5 and the first bracing surface 6. The second connection point 11 is delineated as the meeting point of the second cavity surface 8 and the second bracing surface 7. Furthermore, the first connection point 10 and the second connection point 11 function as additional gripping features within each of the plurality of engagement features 4 so that the present invention is able to bite into the fastener head. Depending upon different embodiments of the present invention, the first connection point 10 and the second connection point 11 function can be a sharp point or a curved section (smooth section) as preferred by the user.

In reference to a first embodiment of the present invention, the first cavity surface 5 comprises a first convex section 21 and a first arc section 22 as shown in FIG. 1-10. The second cavity surface 8 comprises a second convex section 23 and a second arc section 24 as shown in FIG. 1-10. More specifically, the first convex section 21 and the first arc section 22 are adjacently connected to each other thus delineating the general shape of the first cavity surface 5. The first convex section 21 is terminally connected to the first bracing surface 6 through the first connection point 10, wherein the first convex section 21 is positioned in between the first arc section 22 and the first bracing surface 6. Furthermore, the second convex section 23 and the second arc section 24 are adjacently connected to each other thus delineating the general shape of the second cavity surface 8. The second convex section 23 is terminally connected to the second bracing surface 7 through the second connection point 11, wherein the second convex section 23 is positioned in between the second arc section 24 and the second bracing surface 7.

Preferably, the first embodiment of the present invention, as shown in FIG. 1-10, a length of the first bracing surface 6 is less than a length of the first convex section 21. A length of the second bracing surface 7 is less than a length of the second convex section 23. The length of the first convex section 21 is less than a length of the first arc section 22. The length of the second convex section 23 is less than a length of the second arc section 24. A diameter of the first convex section 21 is greater than a diameter of the first arc section 22. A diameter of the second convex section 23 is greater than a diameter of the second arc section 24. However, in some configurations of the first embodiment, the length of the first bracing surface 6 can be equal or greater than the length of the first convex section 21. The length of the second bracing surface 7 can be equal or greater than the length of the second convex section 23. The length of the first convex section 21 can be equal or greater than the length of the first arc section 22. The length of the second convex section 23 can be equal or greater than the length of the second arc section 24. The diameter of the first convex section 21 can be equal or less than the diameter of the first arc section 22. The diameter of the second convex section 23 can be equal or less than the diameter of the second arc section 24.

Figure 11:
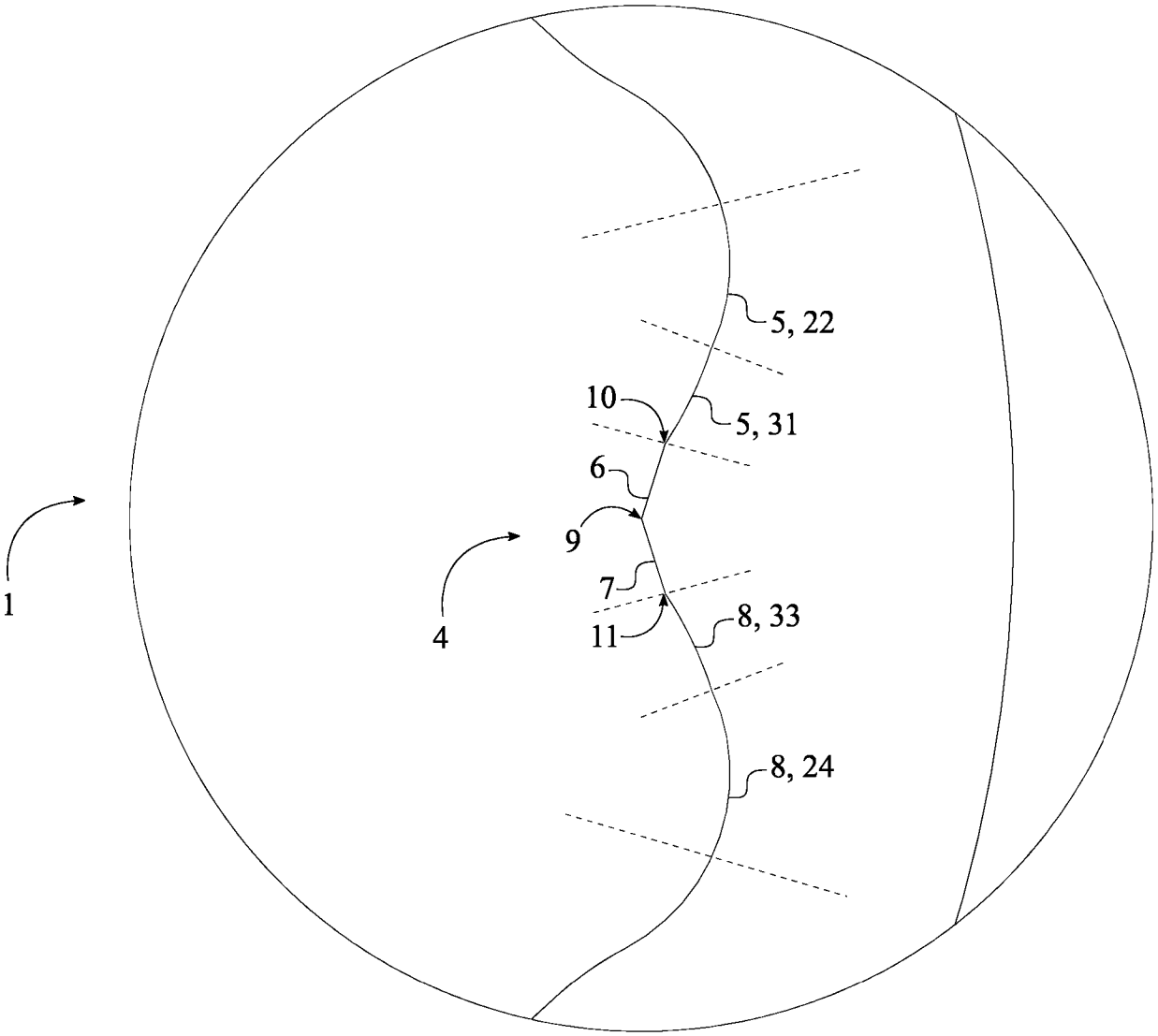
FIG. 11 is a detailed view showing one of the plurality of engagement features of an embodiment of the present invention, showing the first concave section and the second concave section.

In reference to a second embodiment of the present invention, the first cavity surface 5 comprises a first concave section 31 and a first arc section 22 as shown in FIG. 11. The second cavity surface 8 comprises a second concave section 33 and a second arc section 24 as shown in FIG. 11. More specifically, the first concave section 31 and the first arc section 22 are adjacently connected to each other thus delineating the general shape of the first cavity surface 5. The first concave section 31 is terminally connected to the first bracing surface 6 through the first connection point 10, wherein the first concave section 31 is positioned in between the first arc section 22 and the first bracing surface 6. Furthermore, the second concave section 33 and the second arc section 24 are adjacently connected to each other thus delineating the general shape of the second cavity surface 8. The second concave section 33 is terminally connected to the second bracing surface 7 through the second connection point 11, wherein the second concave section 33 is positioned in between the second arc section 24 and the second bracing surface 7.

Preferably, the second embodiment of the present invention, as shown in FIG. 11, the length of the first bracing surface 6 is less than a length of the first concave section 31. The length of the second bracing surface 7 is less than a length of the second concave section 33. The length of the first concave section 31 is less than the length of the first arc section 22. The length of the second concave section 33 is less than the length of the second arc section 24. A diameter of the first concave section 31 is greater than the diameter of the first arc section 22. A diameter of the second concave section 33 is greater than the diameter of the second arc section 24. However, in some configurations of the second embodiment, the length of the first bracing surface 6 can be equal or greater than the length of the first concave section 31. The length of the second bracing surface 7 can be equal or greater than the length of the second concave section 33. The length of the first concave section 31 can be equal or greater than the length of the first arc section 22. The length of the second concave section 33 can be equal or greater than the length of the second arc section 24. The diameter of the first concave section 31 can be equal or less than the diameter of the first arc section 22. The diameter of the second concave section 33 can be equal or less than the diameter of the second arc section 24.

Figure 12:
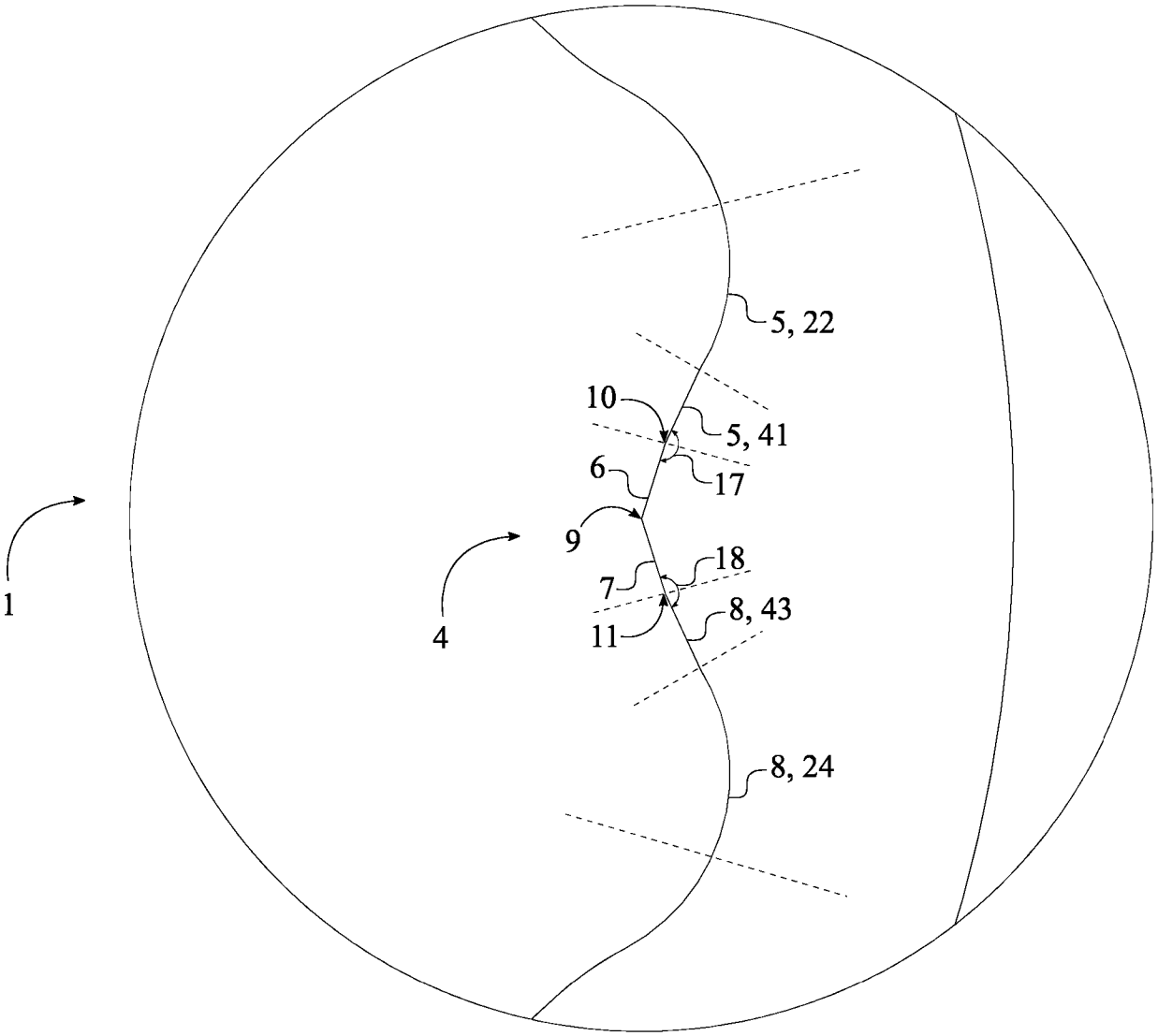
FIG. 12 is a detailed view showing one of the plurality of engagement features of an embodiment of the present invention, showing the first angled section and the second angled section.

In reference to a third embodiment of the present invention, the first cavity surface 5 comprises a first angled section 41 and a first arc section 22 as shown in FIG. 12. The second cavity surface 8 comprises a second angled section 43 and a second arc section 24 as shown in FIG. 12. More specifically, the first angled section 41 and the first arc section 22 are adjacently connected to each other thus delineating the general shape of the first cavity surface 5. The first angled section 41 is terminally connected to the first bracing surface 6 through the first connection point 10 and a first obtuse angle 17. The first angled section 41 is positioned in between the first arc section 22 and the first bracing surface 6 in such a way that the first obtuse angle 17 ranges from 135 degrees to 179 degrees. Furthermore, the second angled section 43 and the second arc section 24 are adjacently connected to each other thus delineating the general shape of the second cavity surface 8. The second angled section 43 is terminally connected to the second bracing surface 7 through the second connection point 11 and a second obtuse angle 18. The second angled section 43 is positioned in between the second arc section 24 and the second bracing surface 7 in such a way that the second obtuse angle 18 ranges from 135 degrees to 179 degrees.

Figure 10:
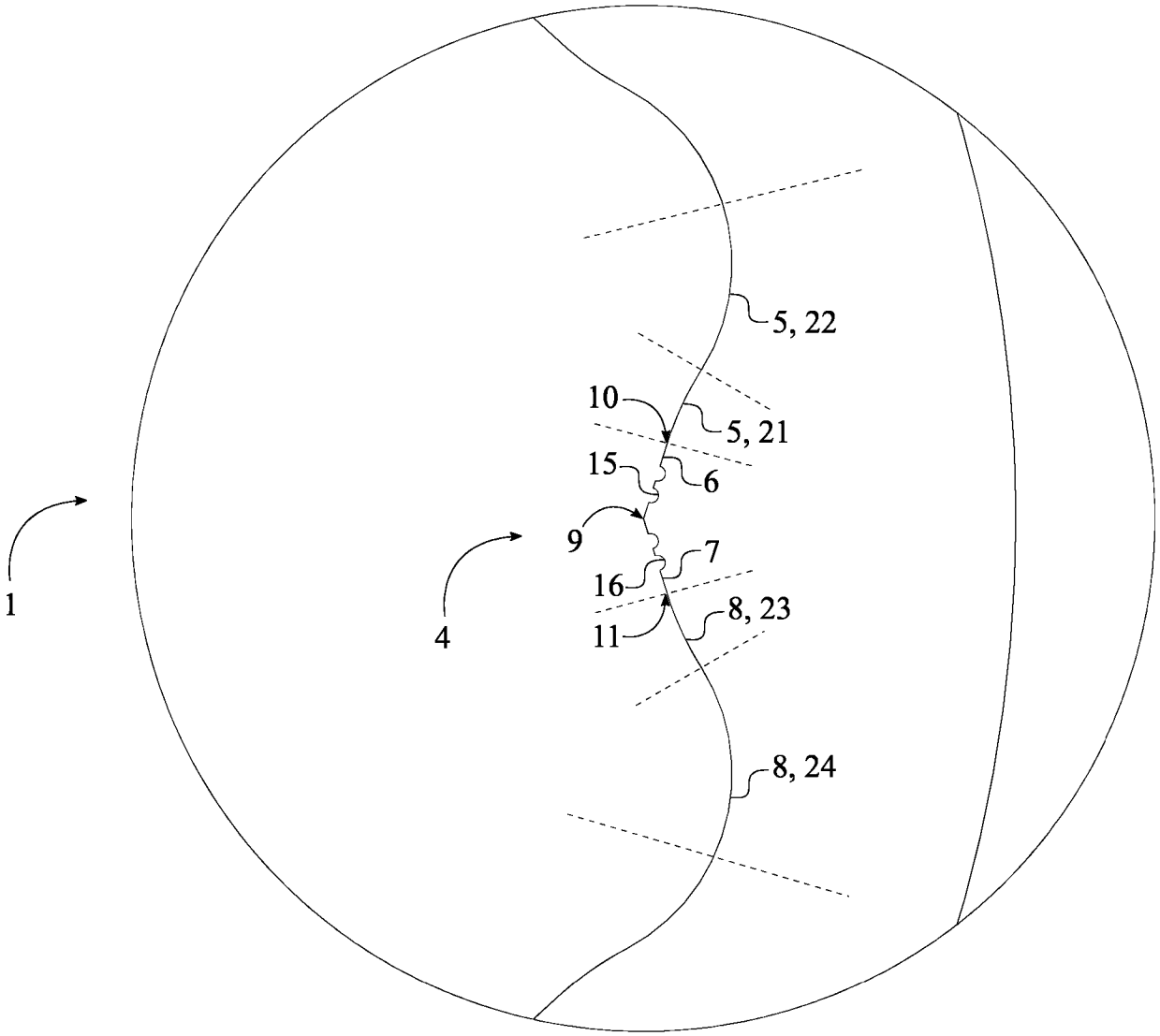
FIG. 10 is a detailed view showing one of the plurality of engagement features of the preferred embodiment of the present invention, showing the first set of serrations and the second set of serrations.

The present invention further comprise a first set of serrations 15 and a second set of serrations 16 to provide additional gripping points as shown in FIG. 10. More specifically, the first set of serrations 15 laterally traverses into the torque-tool body 1 from the first bracing surface 6. The second set of serrations 16 laterally traverses into the torque-tool body 1 from the second bracing surface 7. The integration of the first set of serrations 15 and the second set of serrations 16 to the present invention depend upon user preference and/or industry rules and regulations. For example, some embodiments of the present invention can be manufactured without the first set of serrations 15 and the second set of serrations 16. Some embodiments of the present invention can be manufactured with the first set of serrations 15 and the second set of serrations 16. Some embodiments of the present invention can be manufactured with only the first set of serrations 15. Some embodiments of the present invention can be manufactured with only the second set of serrations 16. Alternatively, the first set of serrations 15 and the second set of serrations 16 can be substituted for ribs which may be protrusions. It is understood that serrations 15 and the second set of serrations 16 may be placed in any location within each of the plurality of engagement features 4 and are not limited to the first bracing surface 6 or the second bracing surface 7.

Figure 8:
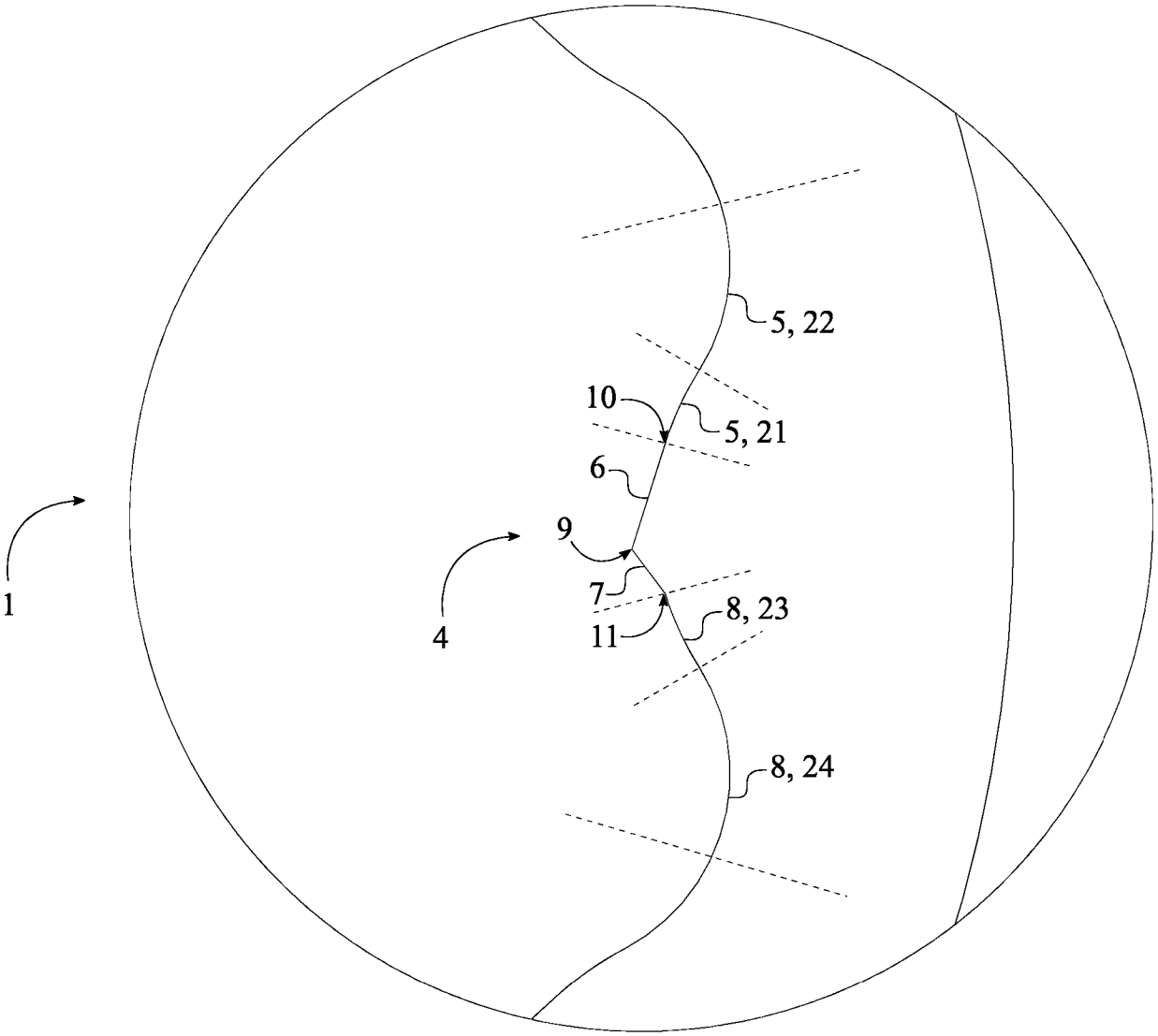
FIG. 8 is a detailed view showing one of the plurality of engagement features of the preferred embodiment of the present invention, wherein a length of the first bracing surface is greater than a length of the second bracing surface.
Figure 9:
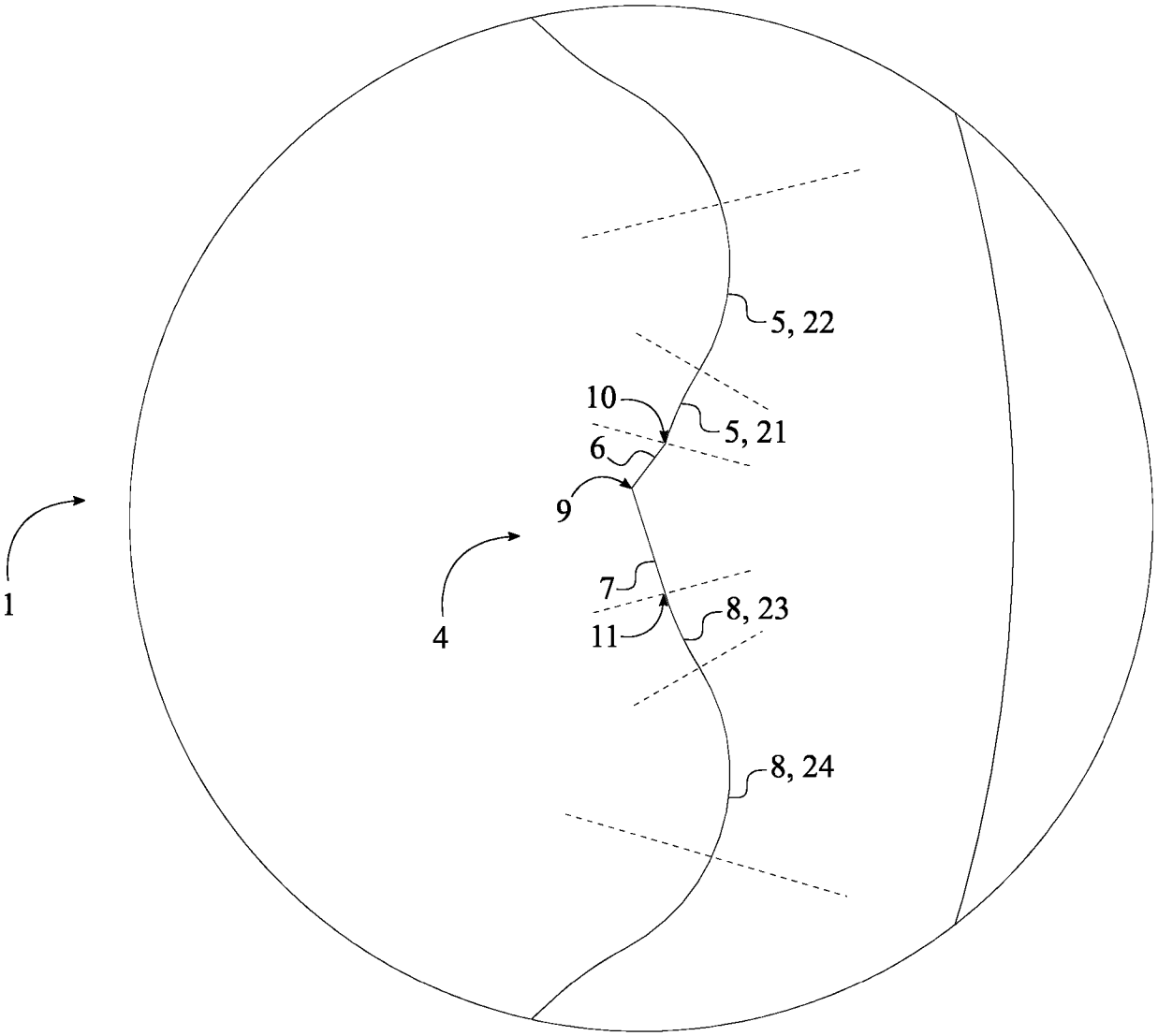
FIG. 9 is a detailed view showing one of the plurality of engagement features of the preferred embodiment of the present invention, wherein a length of the second bracing surface is greater than a length of the first bracing surface.

The general profile of the first bracing surface 6 and the second bracing surface 7 can differ upon the length of the first bracing surface 6 and the length of the second bracing surface 7. In the preferred embodiment of the present invention, the length of the first bracing surface 6 is equal to the length of the second bracing surface 7 as shown in FIG. 6. In some embodiment of the present invention, the length of the first bracing surface 6 is greater than the length of the second bracing surface 7 as shown in FIG. 8. In some embodiment of the present invention, the length of the second bracing surface 7 is greater than the length of the first bracing surface 6 as shown in FIG. 9.

In reference to FIG. 4, the plurality of engagement features 4 is twelve engagement features within the present invention. However, the plurality of engagement features 4 can also be six engagement features within an alternative embodiment the present invention. Furthermore, the first bracing surface 6 of an arbitrary engagement feature from the plurality of engagement features 4 is not parallel to the first bracing surface 6 of an adjacent engagement feature from the plurality of engagement features 4. Furthermore, the first bracing surface 6 of the arbitrary engagement feature and the second bracing surface 7 of the adjacent engagement feature are not co-planer.

Although the invention has been explained in relation to its preferred embodiment, it is to be understood that many other possible modifications and variations can be made without departing from the spirit and scope of the invention as hereinafter claimed.

What is claimed is:

1. An anti-slip torque tool with integrated engagement features comprising:

a torque-tool body;

a plurality of engagement features;

the plurality of engagement features being radially distributed around a rotational axis of the torque-tool body;

each of the plurality of engagement features comprising a first cavity surface, a first bracing surface, a second bracing surface, and a second cavity surface;

the first bracing surface and the second bracing surface being adjacently connected to each other through an intersection point;

the first cavity surface being terminally connected to the first bracing surface through a first connection point;

the first bracing surface being positioned in between the second bracing surface and the first cavity surface;

the second cavity surface being terminally connected to the second bracing surface through a second connection point;

the second bracing surface being positioned in between the first bracing surface and the second cavity surface;

the first cavity surface comprising a first angled section and a first arc section;

the second cavity surface comprising a second angled section and a second arc section;

the first angled section and the first arc section being adjacently connected to each other;

the first angled section being terminally connected to the first bracing surface at a first obtuse angle and through the first connection point;

the first angled section being positioned in between the first arc section and the first bracing surface;

the second angled section and the second arc section being adjacently connected to each other;

the second angled section being terminally connected to the second bracing surface at a second obtuse angle and through the second connection point; and the second angled section being positioned in between the second arc section and the second bracing surface.

2. The anti-slip torque tool with integrated engagement features as claimed in claim 1 comprises:

a wrench handle; and the wrench handle being externally and laterally connected to the torque-tool body.

3. The anti-slip torque tool with integrated engagement features as claimed in claim 1 comprises, wherein the torque-tool body being outwardly extended from the plurality of engagement features to an outer wall of the torque-tool body.

4. The anti-slip torque tool with integrated engagement features as claimed in claim 3 comprises:

an attachment body;

a square engagement bore;

the attachment body being centrally positioned around and along the rotational axis;

the attachment body being adjacently connected to the torque-tool body; and the square engagement bore traversing into the attachment body along the rotational axis, opposite of the torque-tool body.

5. The anti-slip torque tool with integrated engagement features as claimed in claim 1 comprises, wherein the first bracing surface and the second bracing surface are angularly positioned to each other about the intersection point.

6. The anti-slip torque tool with integrated engagement features as claimed in claim 1 comprises, wherein the first bracing surface and the second bracing surface are positioned parallel to each other.

7. The anti-slip torque tool with integrated engagement features as claimed in claim 1 comprises:

the first cavity surface comprising a first convex section and a first arc section;

the second cavity surface comprising a second convex section and a second arc section;

the first convex section and the first arc section being adjacently connected to each other;

the first convex section being terminally connected to the first bracing surface through the first connection point;

the first convex section being positioned in between the first arc section and the first bracing surface;

the second convex section and the second arc section being adjacently connected to each other;

the second convex section being terminally connected to the second bracing surface through the second connection point; and the second convex section being positioned in between the second arc section and the second bracing surface.

8. The anti-slip torque tool with integrated engagement features as claimed in claim 7 comprises:

wherein a length of the first bracing surface is less than a length of the first convex section;

wherein a length of the second bracing surface is less than a length of the second convex section;

wherein the length of the first convex section is less than a length of the first arc section;

wherein the length of the second convex section is less than a length of the second arc section;

wherein a diameter of the first convex section is greater than a diameter of the first arc section; and wherein a diameter of the second convex section is greater than a diameter of the second arc section.

9. The anti-slip torque tool with integrated engagement features as claimed in claim 1, wherein the first obtuse angle ranges from 135 degrees to 179 degrees.

10. The anti-slip torque tool with integrated engagement features as claimed in claim 1, wherein the second obtuse angle ranges from 135 degrees to 179 degrees.

11. The anti-slip torque tool with integrated engagement features as claimed in claim 1 comprises;

wherein the first connection point being a sharp point; and wherein the second connection point being a sharp point.

12. The anti-slip torque tool with integrated engagement features as claimed in claim 1 comprises;

wherein the first connection point being a curved section; and wherein the second connection point being a curved section.

13. The anti-slip torque tool with integrated engagement features as claimed in claim 1, wherein the intersection point is a sharp point.

14. The anti-slip torque tool with integrated engagement features as claimed in claim 1, wherein the intersection point is a curved section.

15. The anti-slip torque tool with integrated engagement features as claimed in claim 1 comprises:

a first set of serrations; and the first set of serrations being laterally traversing into the torque-tool body from the first bracing surface.

16. The anti-slip torque tool with integrated engagement features as claimed in claim 1 comprises:

a second set of serrations; and the second set of serrations being laterally traversing into the torque-tool body from the second bracing surface.

17. The anti-slip torque tool with integrated engagement features as claimed in claim 1 comprises, wherein a length of the first bracing surface is equal to a length of the second bracing surface.

18. The anti-slip torque tool with integrated engagement features as claimed in claim 1 comprises, wherein a length of the first bracing surface is greater than a length of the second bracing surface.

19. The anti-slip torque tool with integrated engagement features as claimed in claim 1 comprises, wherein a length of the second bracing surface is greater than a length of the first bracing surface.

20. The anti-slip torque tool with integrated engagement features as claimed in claim 1 comprises, wherein the plurality of engagement features is twelve engagement features.

* * * * *